US005299983A

United States Patent [19]

Pfost et al.

[11] Patent Number: 5,299,983

[45] Date of Patent: Apr. 5, 1994

[54] DOUBLE ACTION VARIABLE FORCE POOL CUE

[76] Inventors: R. Fred Pfost, 1090 Eastwood Ct., Los Altos, Calif. 94022; Dale R. Pfost, 31 Main Road Fyfield, Abbingdon, Oxon, England, OX13 5LU

[21] Appl. No.: 90,764

[22] Filed: Jul. 12, 1993

[51] Int. Cl.[5] ..... A63D 15/08

[52] U.S. Cl. ..... 473/45

[58] Field of Search ..... 273/129 J, 129 V, 129 W, 273/129 S; 473/44, 45, 48

[56] References Cited

U.S. PATENT DOCUMENTS

| | | | |
|---|---|---|---|
| 673,693 | 5/1901 | Beaufils | 473/45 |
| 673,753 | 5/1901 | Beaufils | 473/45 |
| 1,054,830 | 3/1913 | Crabb | 473/45 |
| 1,182,530 | 5/1916 | Doane | 473/45 |
| 1,604,023 | 10/1926 | Coyle | 473/45 |
| 3,447,805 | 6/1969 | Baley | 473/45 |
| 3,495,826 | 2/1970 | Mizgala | 473/45 |
| 3,897,061 | 7/1975 | Grattan | 473/45 |
| 4,134,588 | 1/1979 | Di Luzio | 273/69 |
| 4,526,370 | 7/1985 | Mortellacci | 473/45 |
| 4,634,123 | 1/1987 | Cowan et al. | 273/69 |
| 4,718,671 | 1/1988 | Desmond et al. | 273/68 |

*Primary Examiner*—Mark S. Graham

*Attorney, Agent, or Firm*—Schneck & McHugh

[57] ABSTRACT

A telescoping pool cue or similar ball-striking device wherein a continuously variable amount of energy is stored. A main spring within an elongated handle is held in compression by a ratchet and pawl which provides an audible or visible signal of the amount of stored energy. A telescoping member may be marked with vernier indicia to visibly indicate the amount of stored energy or an electronic display provided. The main spring urges an outer plunger forwardly, but an actuator spring urges an inner plunger rearwardly. Upon release, the inner plunger moves rearward to release the pawl and ratchet after which both plungers move forwardly. This reciprocal action allows the cue to begin and end a stroke near the desired point of impact.

23 Claims, 6 Drawing Sheets

DOUBLE ACTION VARIABLE FORCE POOL CUE

TECHNICAL FIELD

This invention relates to a spring driven impacting device for striking balls and more particularly, it relates to a device for propelling balls in games such as billiards.

BACKGROUND ART

Numerous telescoping spring driven pool cues have been described in the prior art. In most such telescoping pool cues, an inner shaft compresses a spring within a handle. The shaft is latched in a cocked position until released. Spring force drives the shaft forward against an object. A representative example is U.S. Pat. No. 4,134,588 to Di Luzio, which describes a spring actuated short billiard cue stick having a plunger shaft in the bore of a handle member, the shaft being slotted longitudinally in the bore with spaced enlargements therealong, so that a manually releasable latch member that slides along the slot can hold the shaft at a number of retracted positions. U.S. Pat. No. 4,634,123 to Cowan et al. describes a similar device that includes an adjustable stand attached to the front of the device. U.S. Pat. No. 4,718,671 to Desmond et al. describes a spring driven, telescopingly adjustable cue wherein the spring is held at various biases by friction between an inner plunger and a handle within which the inner plunger is encased.

These devices, however, do not offer an easily reproducible means for striking objects, as the force imparted by the shaft varies with the distance the shaft is positioned from the object prior to striking. Since the trajectory of the object also typically varies depending upon the point of impact on the object, the distance the shaft is positioned from the object prior to striking also introduces an angular error in the trajectory, as it makes the point of impact harder to predict.

In pool or billiards, accuracy is mostly a matter of experience. It is difficult to apply a continuously variable amount of force in a reproducible manner time after time, and difficult to strike a ball at the exact point of impact desired. Yet if this could be done, it would allow higher levels of play by less experienced players. It would also facilitate teaching of pool, billiards or similar games.

An object of the invention is to devise a compact pool cue which delivers a continuously variable force in a reproducible manner.

SUMMARY OF THE INVENTION

The above object has been met with a telescoping pool cue which employs a cocking mechanism which allows a continuously variable amount of energy to be stored. The amount of stored energy is signalled either audibly, visually or electronically. A tip of the cue is positioned at the start of a stroke adjacent to the target object at the desired point of impact. Upon release, the tip is first retracted a set amount, then is propelled forward to impact the object with a known momentum. This retraction from the target a set distance, followed by forward acceleration the same set distance is termed "double action". All of this may occur in a fraction of a second so that to the eye of a user the tip remains positioned adjacent to the target until the time of impact. In this manner, reproducible amounts of force at known points of impact are obtained, leading to greater accuracy.

The telescoping cue of the present invention involves at least two parallel plungers powered by at least two springs, in a push-pull arrangement explained below, all of which is housed, in the manner of a collapsible telescope, within a body and activated by a trigger. In a first embodiment, an inner plunger is slidably encased within an outer plunger. The two plungers are connected by an actuator spring that can be held in tension by a latch that holds the position of the plungers relative to each other.

The inner plunger may have a cue tip attached which protrudes from the plunger at the front, and the inner plunger can be pulled forward relative to the outer plunger to a position where the latch engages. The outer plunger is then pushed back against the force of a main spring that connects the outer plunger to the body, and a pawl engages a ratchet at a desired energy storage level to hold the outer plunger at this position. The engagement position of the pawl is signalled by audible clicks against teeth of the ratchet or is known from vernier marks visible on the outer plunger at the entrance into the cue body, or the force can be electronically measured and visually displayed. The electronic measurement and display may involve a small microphone mounted within the body in series with an electronic circuit that counts pulses from the microphone generated by the audible clicks and displays the count.

The known position of the tip at the beginning of a stroke combined with the known position of the pawl allows force and velocity to be predictable, repeatable and adjustable. When the trigger on the body is pressed the latch disengages, allowing the inner plunger to travel backward a set amount relative to the outer plunger, where it causes the pawl to release. The outer plunger, along with the inner plunger, then travels forward due to the force stored in the main spring impacting a target.

A second embodiment of the invention is much like the first, but also incorporates a lever to draw the outer plunger backward against the force of the spring. Since force and velocity of impact are known and repeatable from the engagement position of the pawl, and the cue tip can be positioned exactly at the desired point of impact, the cue stick of the present invention leads to higher accuracy in ball velocities and trajectories.

BEST MODE FOR CARRYING OUT THE INVENTION

Figure 1:
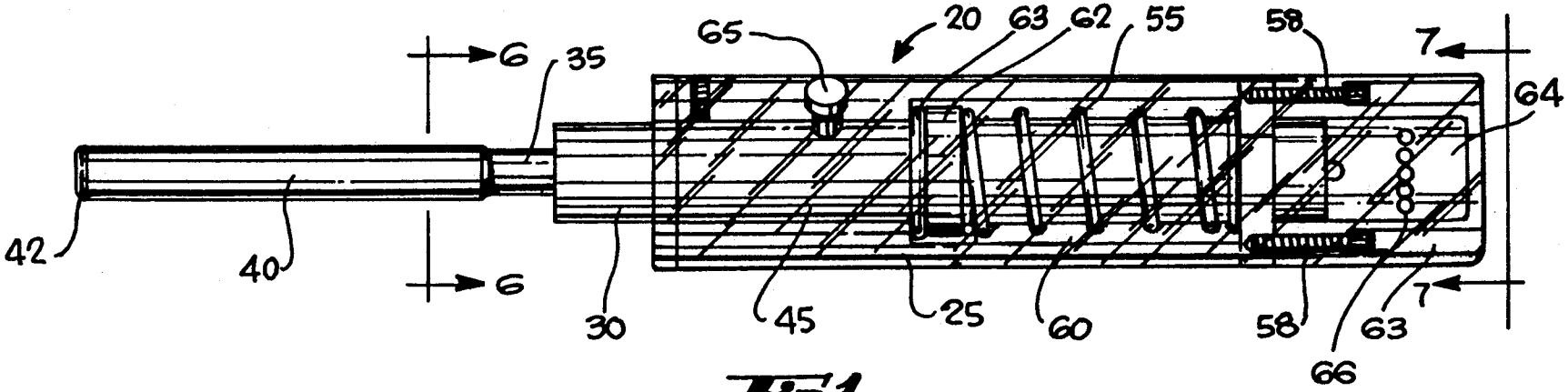
FIG. 1 is a side view of a first embodiment of the telescoping pool cue of the present invention.

Referring to FIG. 1, a spring actuated cue 20 can be seen to include a body 25 which houses an outer plunger 30 which is shown protruding from a front of the body 25. An inner plunger 35 is slidably encased within the outer plunger 30 and is shown protruding from a front of the outer plunger 30. An extension 40 which can be any length and has a tip 42 similar to the ball striking end of a pool cue, is attached to a front of the inner plunger 35. The outer plunger 30 can be seen to be encased within a bore 45 in the body 25. A main spring 55 is shown coiled around the outer plunger 30 within an enlarged section 60 of the bore 45. The spring 55 is contained at a front end by a collar 62 affixed to the outer plunger 30. An 0-ring 63 through which the outer plunger 30 freely slides is contained within a front end of the enlarged section 60 of the bore 45, and acts to stop the collar 62. A trigger 65 protrudes outside the body 25. A plurality of recessed screws 58 is shown holding a rear cap 63 to the body 25 by threading into holes in the body 25. An optional electronics module 64 with display lamps 66 may be housed in rear cap 63. The purpose of the electronics module is explained below.

Figure 2:
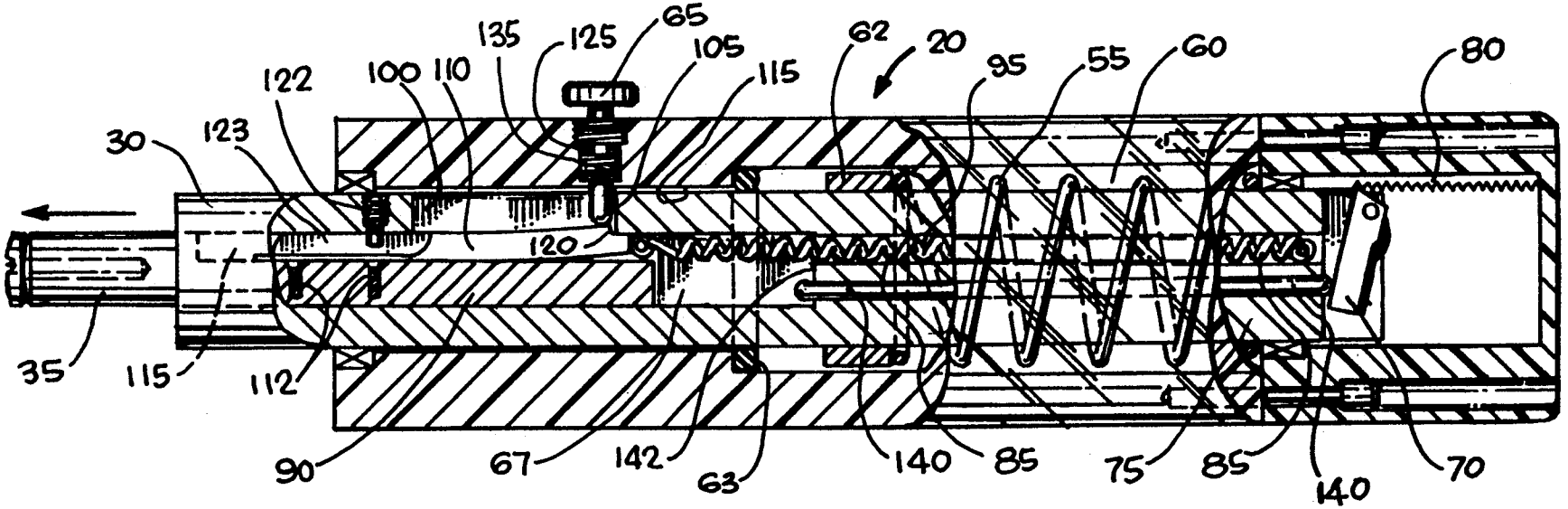
FIG. 2 is a side partial cut-away view of the telescoping pool cue of FIG. 1 in a partially cocked position.

In FIG. 2 the outer plunger 30 can be seen to provide a cavity 67 which may be traversed by the inner plunger 35. A pawl 70 is attached to a rear portion 75 of the outer plunger 30. The pawl 70 is disposed to engage with a ratchet 80 located along a side of the bore 45 in a latching relation. An actuator spring 85 connects a rear portion 90 of the inner plunger 35 with the rear portion 75 of the outer plunger 30, the actuator spring 85 extending through a hole 95 in the outer plunger 30.

A forward chamber 100 in the outer plunger 30 that connects the bore 45 with the cavity 67 is shown bordered by a shoulder 105 that extends from a surface of the outer plunger 30 at the bore 45 to the cavity 67. An elongated slightly bent latch 110 is attached to the inner plunger 35 by a pair of screws 112 at a front end of the latch 110. The latch 110 fits in an elongated cut 115 of the inner plunger 35. A rear section of the bent latch 110 is biased to arch away from the main body of inner plunger 35, and has a notch 120 that catches on the shoulder 105. A screw 122 extends into a hollow 123 of the latch 110 and slides within the cut 115 to keep the inner plunger 35 from rotating relative to the outer plunger 30. Seated in an orifice 125 in the body 25 is the trigger 65. The trigger 65 can be pressed from outside to contact the latch 110 but is held back by a trigger spring 135, which is encased in the orifice 125. A push rod 140 extends through a hole that runs from the rear portion 75 of the outer plunger 30 to a back region 142 of the cavity 67. The push rod 140 extends into the cavity 67 at one end and contacts the engaged pawl 70 at another end.

Figure 3:
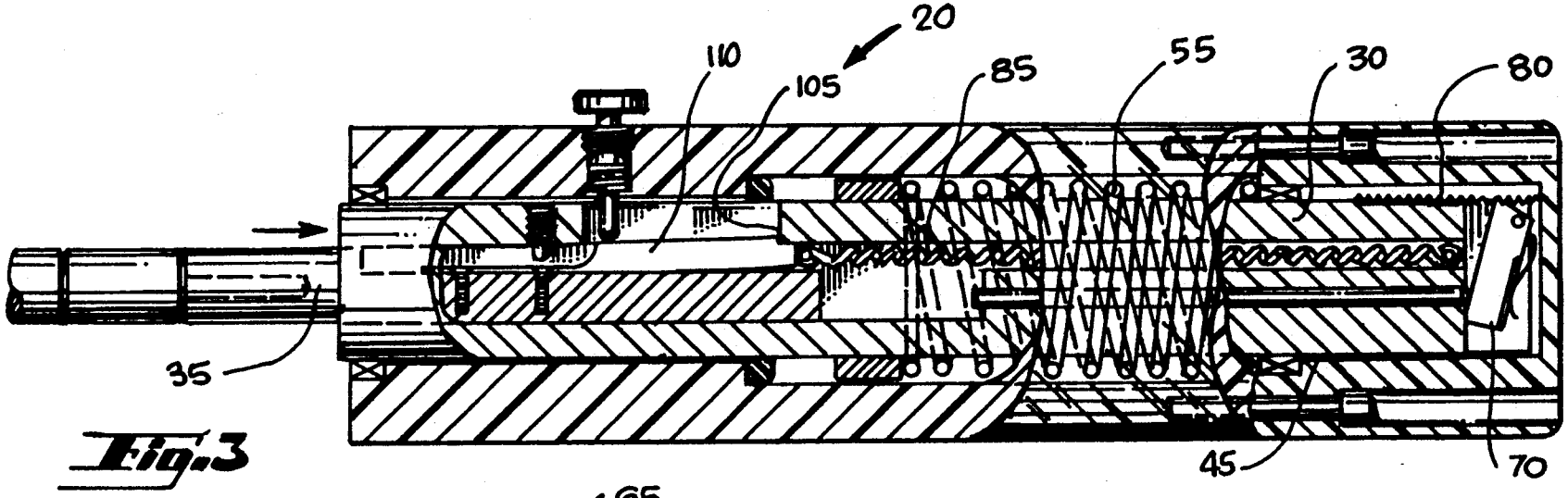
FIG. 3 is a side partial cut-away view of the cue of FIG. 2 in a fully cocked position.

In FIG. 3, the device 20 is shown in a fully cocked position. The latch 110 is caught on the shoulder 105 as before. But now, the outer plunger 30 is drawn back toward a back end of the bore 45, where it is held against the force of the main spring 55 by the pawl 70 engaged with the ratchet 80. Since the inner plunger 35 is held by the actuator spring 85 against moving forward relative to the outer plunger, and is held by the latch 110 and the shoulder 105 against moving backward relative to the outer plunger 30, the inner plunger 35 is drawn back in tandem with the outer plunger 30.

Figure 4:
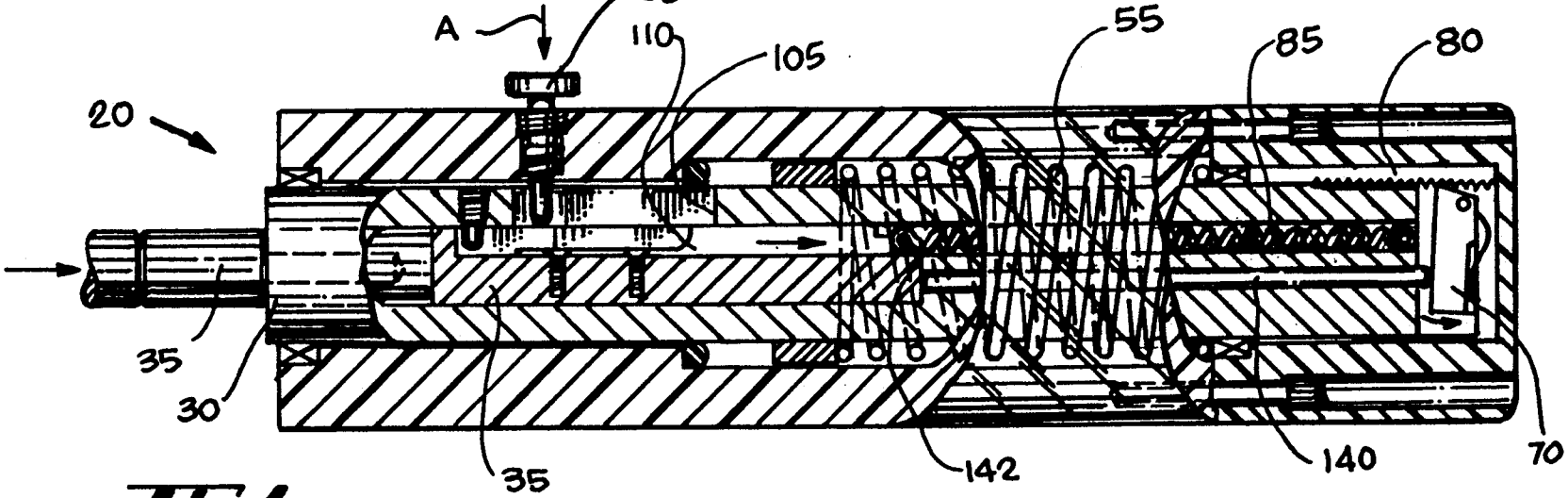
FIG. 4 is a side partial cut-away view of the cue of FIG. 2 during firing.

In FIG. 4, the device 20 is actuated by motion of the trigger 65, indicated by arrow A. The trigger 65 is pushed down by an outside force, typically provided by the hand of an operator, which frees the bent latch 110 from the shoulder 105. The latch 110 then slides, along with the inner plunger 35, pulled by the actuator spring 85 rearward approximately one half inch within the cavity 50 to where the inner plunger 35 displaces the push rod 140 from the back region 142 of the cavity 67. This causes the push rod 140 to push against the pawl 70, disengaging the pawl 70 from the ratchet 80. With the pawl 70 disengaged from the ratchet 80, the force stored in the main spring 55 is released to propel the outer plunger 30 and the inner plunger 35 forward to impact a ball or the like.

Figure 5:
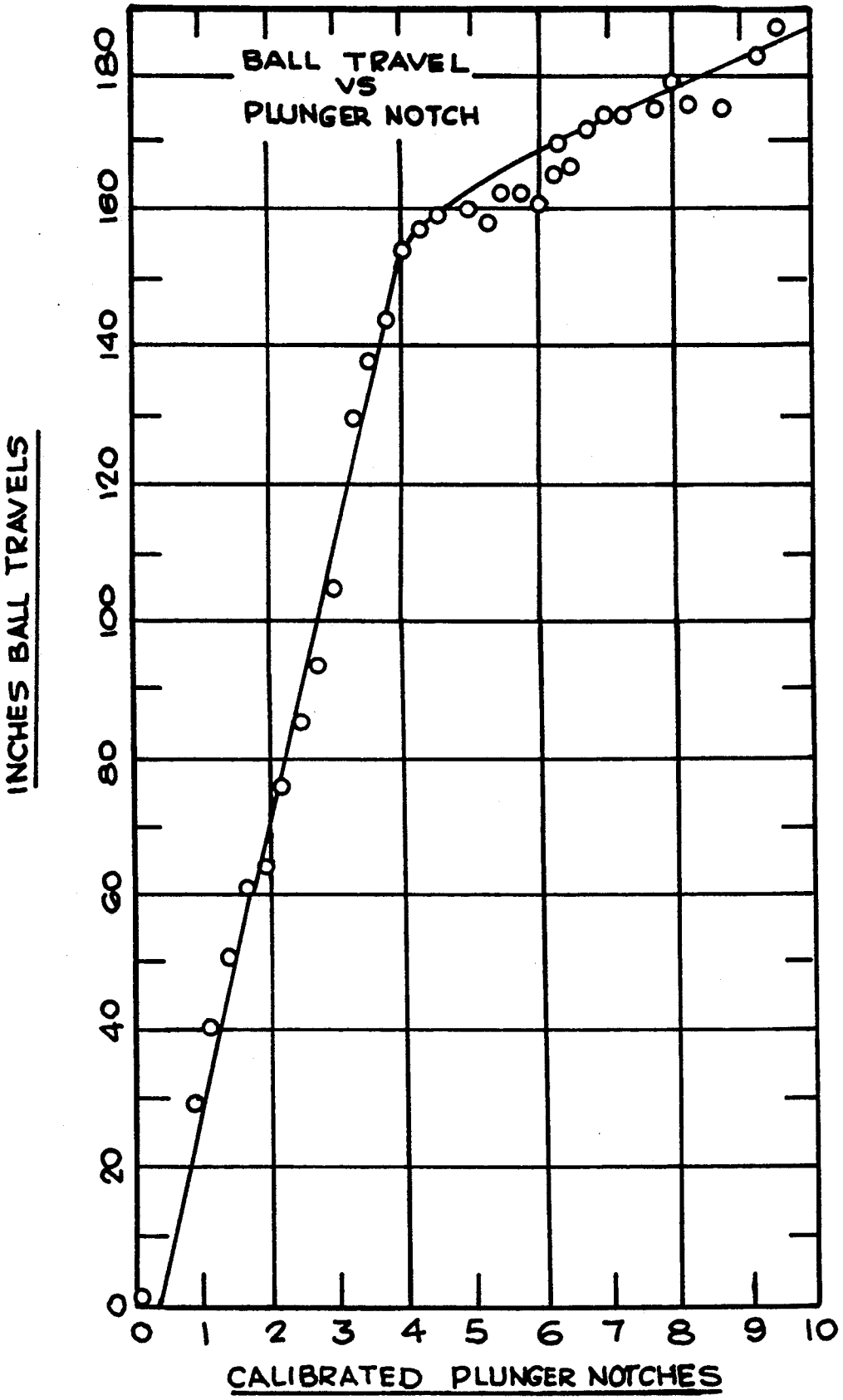
FIG. 5 is a graph of the distance travelled by a ball versus calibration marks on the body of the cue of FIG. 1.

FIG. 5 is a typical graph showing distance traveled by a target ball, plotted in inches on the vertical scale, versus a calibrated setting to which the outer plunger is retracted prior to impact. Note that ball travel remains proportional to main spring 55 compression until saturation at high levels of ball travel. Calibration marks may be placed on the outer plunger at the region where it enters the body 25. The marks, termed "plunger notches" in FIG. 5, correspond to ratchet teeth spacings of ratchet 80. There are no teeth for about the first half inch of rearward motion. Each ratchet click corresponds to a plunger notch being passed by pawl 70 so that the clicks are a distance measurement which, for compression of springs, translates to an energy storage measurement. By counting notches, either audibly, visually or electronically, the amount of continuously variable energy or force stored in the main spring may be gauged so that these quantities, as well as the impulse imparted to the ball at impact can be known and repeatable for different notch settings. This leads to far greater accuracy than for cue sticks of the prior art. The term "continuously variable" force is to be understood to be limited by the spacing of the ratchet teeth.

The ratchet teeth may be spaced more closely together toward a front end of the ratchet 80 than toward a rear end, to provide more force levels for low velocity shots. As the force between the pawl 70 and ratchet teeth is less for these force settings, the teeth can be made smaller without wearing out. The teeth spacings may range from 20 mils at the front of the ratchet to 100 mils at the rear.

Figure 6:
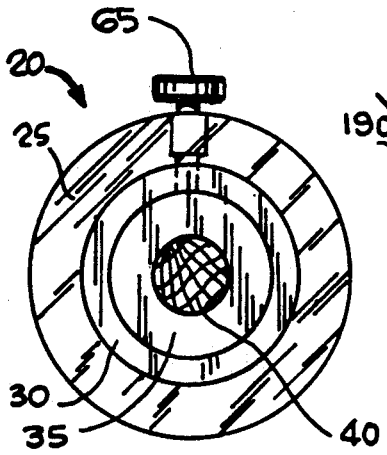
FIG. 6 is a cross sectional diagram of the cue of FIG. 1 taken along lines 6—6.

In FIG. 6 note that cue 20 has a generally balanced, cylindrical form. The trigger 65 is evident at the top. The body 25 has a coaxial relation with the outer plunger 30, the inner plunger 35 and the extension 40.

Figure 7:
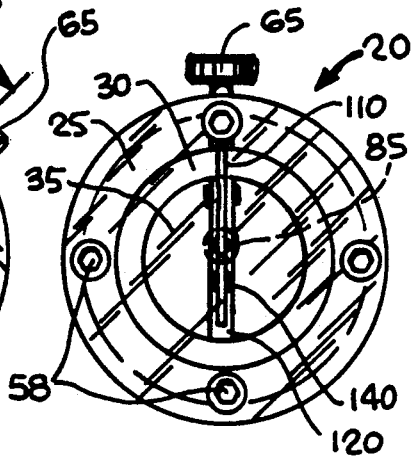
FIG. 7 is a cross sectional diagram of the cue of FIG. 1 taken along lines 7—7.

In FIG. 7 the coaxial relation of the body 25, the outer plunger 30, the inner plunger 35 is evident. Four evenly spaced screws 58 are shown threaded into the body 25 from an end. Aligned with the push rod 140 is the notch 120, the latch 110 and the actuator spring 85.

Figure 8:
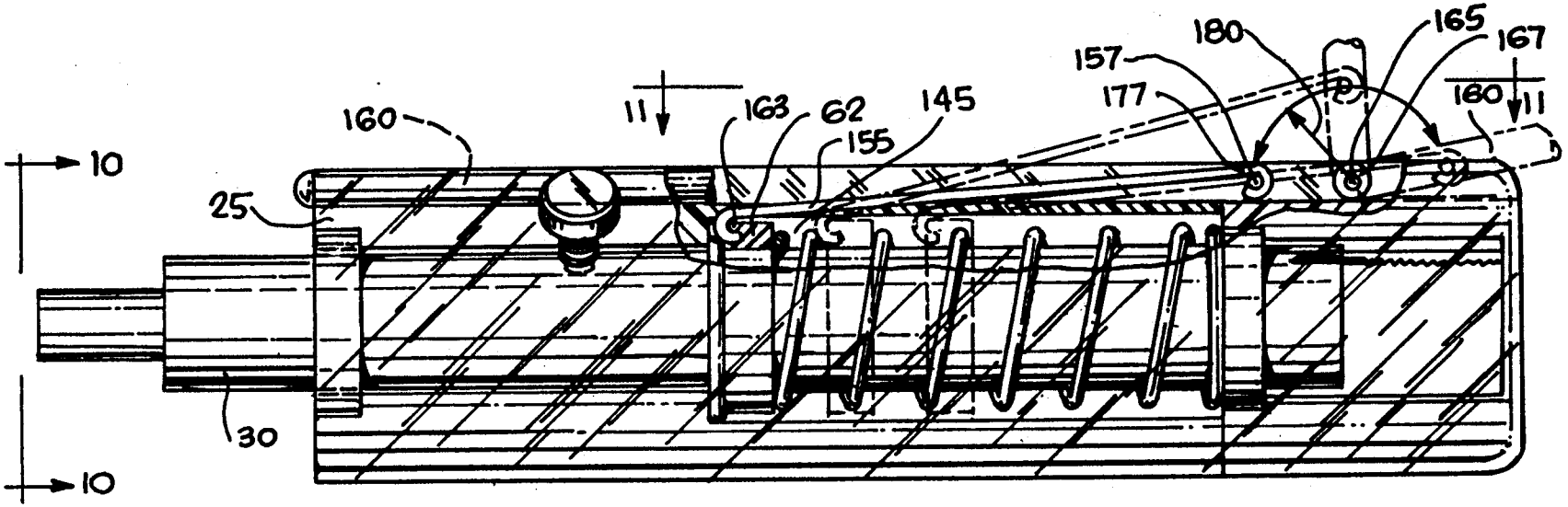
FIG. 8 is a side partial cut-away view of a second embodiment of the cue of the present invention.
Figure 9:
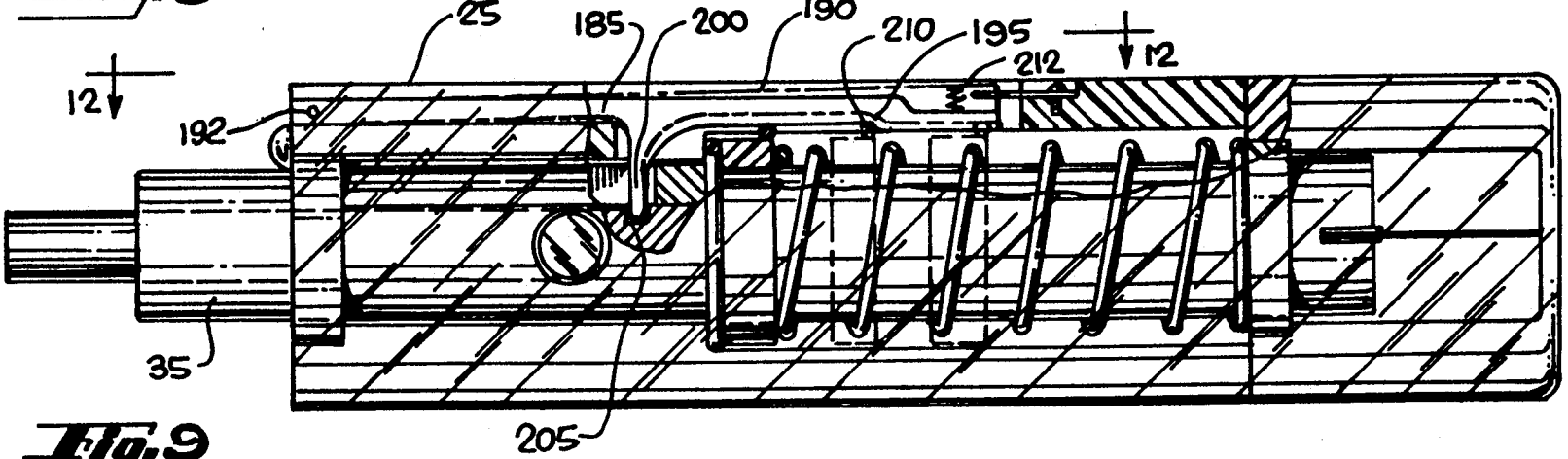
FIG. 9 is a side partial cut-away view of the embodiment of the cue shown in FIG. 8.

Referring now to FIGS. 8 and 9, a second embodiment of the invention is like the first, but includes some additional elements. Lying within a longitudinal furrow 145 of the body 25 is an elongated hook 155 which is attached by a pivot 157 to a lever 160. The hook 155 is in a position to catch on the collar 62 of the outer plunger 30 and slides within the furrow 145. The collar 62 also offers support that the main spring 55 pushes against. The collar 62 has a lip 163 protruding in a direction away from the lever 160 in order to hold the hook 155 to the collar 62.

The lever 160 is attached to the body 25 by a second pivot 165 located at a base 167 of the lever 160, about which the lever 160 is free to rotate within a plane that generally includes the furrow 145 and a longitudinal axis of the device 20. The first pivot 157 of the elongated hook 155 is attached to the lever 160 near a base 177 of the hook 155 but a short distance 180 from the base 167 of the lever 160. This short distance 180 provides a mechanical advantage to an operator holding an end of the lever 160 to pull the collar 62 with the hook 155, thereby allowing a greater force to be stored in the main spring 55, shown in FIGS. 1–4, and a greater impact to be imparted to a target. The distance 180 can be seen to be one half the distance the main spring 155 can be compressed in this embodiment.

Figure 10:
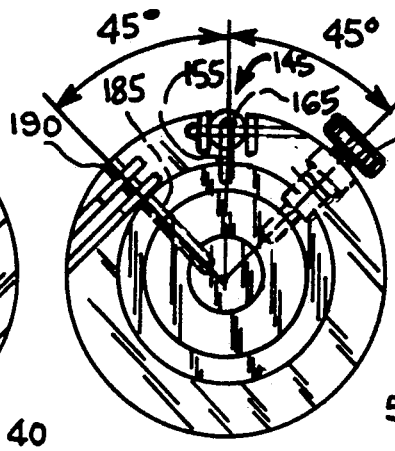
FIG. 10 is an end view of a second embodiment of the invention taken along lines 10—10 in FIG. 8.

In FIG. 9, a key 185 is disposed within a longitudinal channel 190 in the body 25, the key 185 and channel 190 located at a different radial angle from the hook 155, the lever 160 and the furrow 145, the difference in angle being approximately 45°, as seen in FIG. 10. In FIG. 10, the trigger 65 is located at a radial angle that differs from that of the hook 155, lever 160 and furrow 145 and that of the key 185. Returning to FIG. 9, the key 185 is pivotally attached at a front region 192 to the outer plunger 30, and has an inclined section 195 and a lip 200. The lip 200 is disposed to protrude into a recess 205 in the inner plunger 35, thereby causing the inner plunger 35 to remain stationary with respect to the body 25 as the outer plunger 30 is drawn back. However, the inclined section 195 is deflected by a protrusion 210 that is affixed to the collar 62 as the collar 62 moves backward during cocking, causing the lip 200 of the key 185 to withdraw from the recess 205 after the latch 110 has engaged the shoulder 105. A key spring 212 holds the lip 200 within the recess 205 until the lip 200 is forced out of the recess 205 by the deflection of inclined section 195 by the protrusion 210 during cocking. The inner plunger 35 is still held cocked relative to the outer plunger 30 at this point by the latch 110, shoulder 105 and actuator spring 85 (shown in FIGS. 1–4). Now, however, the inner plunger may be released rearwardly, pulled by the small actuator spring 85 in FIG. 2 when the trigger 65 is depressed. The firing sequence proceeds as previously described with the push rod 140 striking the pawl 70, releasing energy stored in the large main spring 55 and driving the outer and inner plungers forwardly to make contact with the ball.

Figure 11:
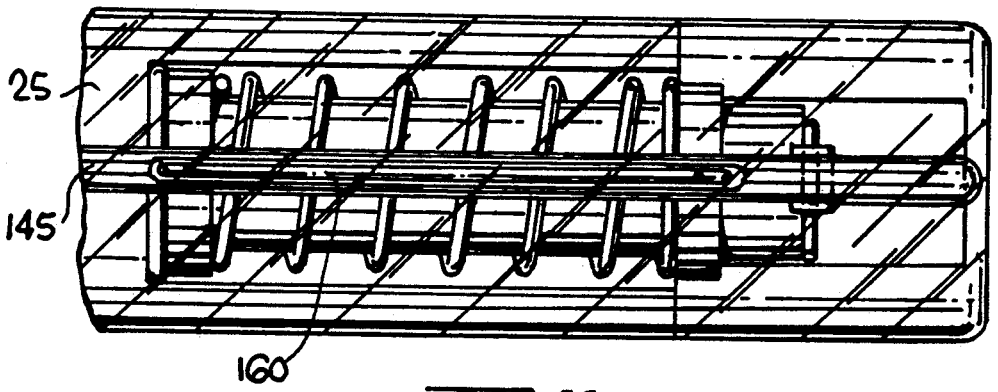
FIG. 11 is a side view of the cue of FIG. 8, taken along lines 11—11 therein.

With reference to FIG. 11, the lever 160 is seen in the longitudinal furrow 145 within body 25. The lever is recessed so that only a small portion protrudes from the body when the cue is in use.

Figure 12:
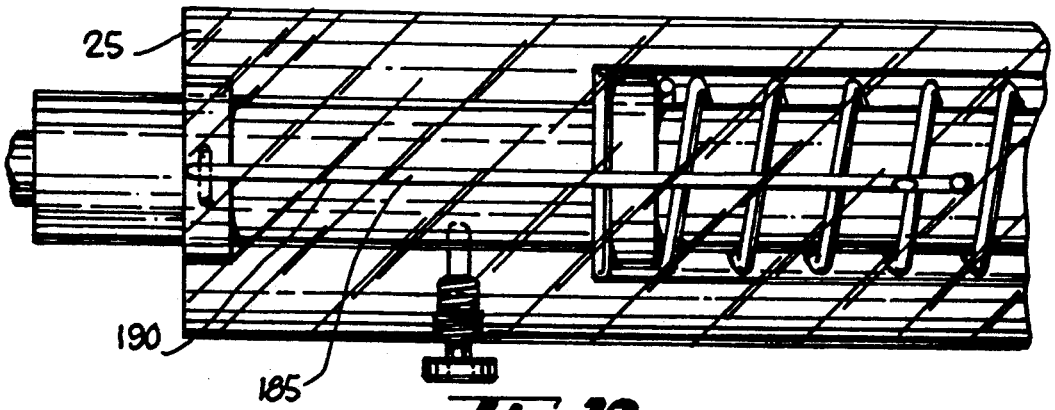
FIG. 12 is a side view of the cue of FIG. 9, taken along lines 12—12 therein.

With reference to FIG. 12, the key 185 resides in the longitudinal channel 190 within the body 25. The key 185 is completely enclosed within the body 25. The lever and key preserve the energy storage mechanisms of the first embodiment, but allow easier cocking action. In the second embodiment, outward extension of the inner plunger is automatic. While cocking, the outer plunger is first caused to be moved backward relative to the inner plunger until the latch engages, and then both plungers move backward in tandem while setting the main spring force.

Figure 13:
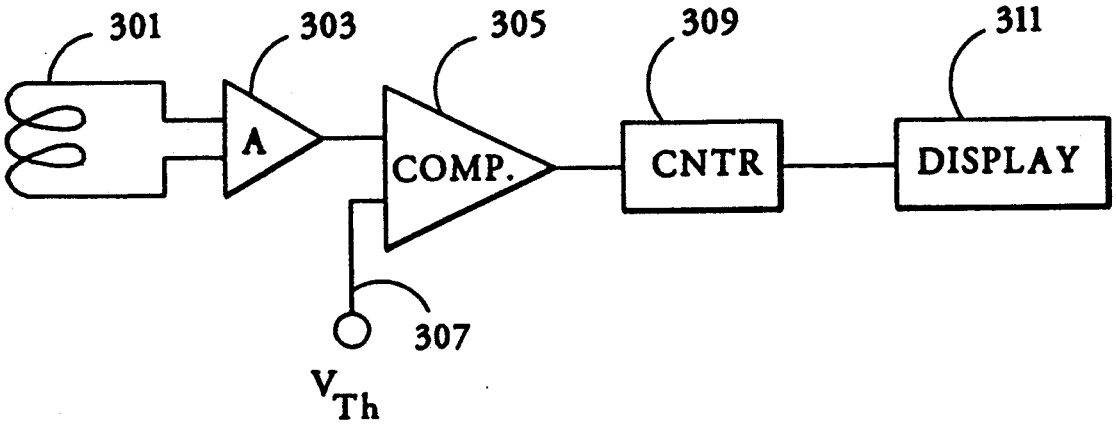
FIG. 13 is a circuit diagram of an electronics module in the pool cue of FIG. 1.

With reference to FIG. 13, the electronics module is seen to include a miniature microphone transducer 301 which picks up audio signals from ratchet clicks and converts the audio signals into an electrical signal which is buffered by amplifier 303 to provide a proportional electrical input signal to comparator 305. The comparator has an input reference signal, $V_{threshold}$, such that the comparator outputs a signal only when the threshold is exceeded. This results in a shaped signal which is an appropriate input for a pulse counter 309. After the trigger 65 is actuated, the counter is reset. The counter drives a display 311 which may be a series of LED lamps recessed in the body 25 of the cue and displaying the number of clicks counted by counter 309, or an alphanumeric two-digit display on the body 25.

Figure 14:
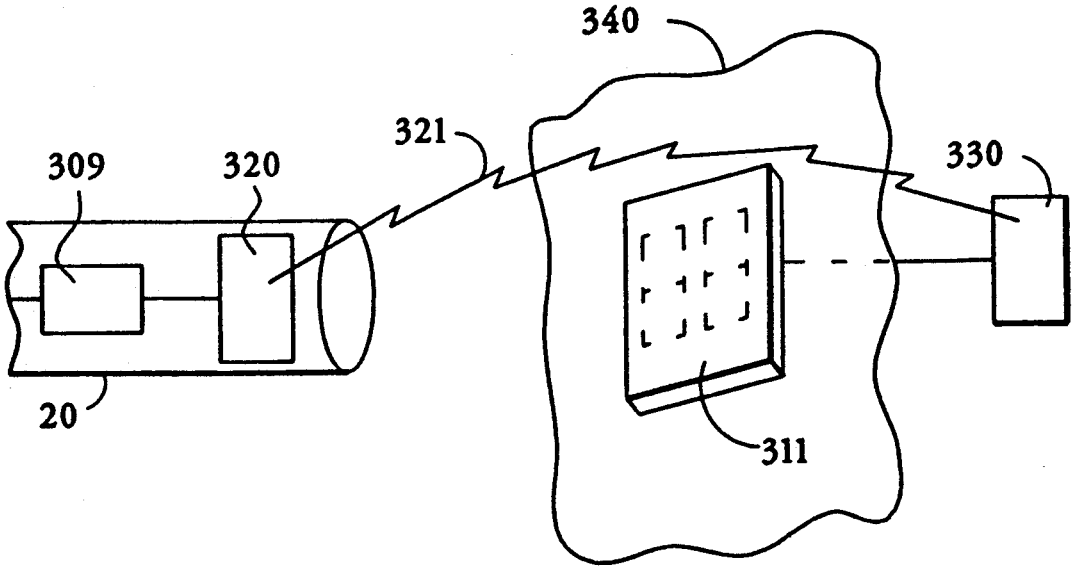
FIG. 14 is a partial perspective view of the pool cue of FIG. 1 and a wall mounted display.

Alternatively, as shown in FIG. 14, the counter 309 may drive a transmitter 320 which emits an electromagnetic signal 321 which is detected by a receiver 330. The receiver 330 is connected to a display 311 located nearby but removed from the cue 20, such as on a wall 340.

All of the components of FIG. 13 may be integrated in circuit chips which are mounted on a small circuit board inserted in the body of the cue, preferably at the rearwardmost portion. The electrical components may be operated by a small battery power supply, not shown. Such a battery power supply will incorporate an on-off switch for deactivating the electronic circuitry. In operation, the audible signal of ratchet clicks is picked up by the microphone transducer 301. The click signal is shaped by the operational amplifier 305, counted by counter 309 and then displayed so that a user is able to gauge the amount of energy stored in the spring. This is especially useful for rapid action of the cue where it may be difficult to audibly distinguish rapidly occurring clicks.

In both embodiments, it is possible to adjust the striking force in a known and reproducible manner to impart accurate velocities and trajectories to balls. For any specific spring setting the trajectories and velocities can be accurately imparted to balls because the cue tip is always placed at the point of impact prior to release of the trigger. The inner plunger then always, upon release of the trigger, retracts a set amount, approximately one half inch, at which point the pawl is released and the plungers are driven forward by the main spring that same set amount. The cue tip thus strikes the ball at the desired point of impact after accelerating the set amount due to the force selected for the main spring.

We claim:

1. A telescoping cue stick for striking a ball comprising, an elongated body having front and back ends and having a longitudinal bore open at the front end, a plunger means slidably disposed in the bore having a tip for striking a ball, double action spring means for imparting bidirectional rearward and forward motion to the plunger means from stored spring energy, wherein the tip may be positioned against a ball at a desired impact point and said spring means draws the tip rearward and forward to the impact point.

2. The apparatus of claim 1 wherein said plunger means comprises an outer plunger slidably encased within the bore and an inner plunger slidably encased within a cavity in the outer plunger.

3. The apparatus of claim 2 wherein the double action spring means comprises an actuator spring having some of said stored energy to retract the inner plunger rearwardly a short distance and a main spring having the remainder of said stored energy to drive the inner and outer plungers forwardly.

4. The apparatus of claim 1 having means for signalling the amount of stored spring energy.

5. The apparatus of claim 4 wherein said means for signalling comprises an electronic circuit with a display.

6. A telescoping cue stick comprising:

an elongated body having front and back ends and having a longitudinal bore open at the front, an inner and outer plunger with axes parallel to that of the body, the outer plunger slidably encased within the bore, the inner plunger slidably encased within a cavity in the outer plunger, a main spring connecting the outer plunger to the body, the main spring disposed to propel the outer plunger forward but held at an adjustable spring force by a pawl affixed to the outer plunger and disposed to engage in a ratchet affixed to the body, an actuator spring connecting the inner plunger to the outer plunger, the actuator spring held at a spring force by a latch on the inner plunger which is disposed to catch on a shoulder of the outer plunger and hold the inner plunger a set distance forward from a rear end of the cavity, the inner plunger disposed to travel rearward the set distance to release the pawl at the release of the latch by a trigger, whereby both plungers travel forward at least the set distance to impact an object.

7. A device as in claim 6 further comprising means for signalling the extent of compression of the main spring thereby yielding a known amount of force transmitted by the device.

8. A device as in claim 6 further comprising:

a push rod located between the pawl and a rear end of the inner plunger, the push rod extending into a rear of the cavity with the pawl engaged in the ratchet, the inner plunger disposed by the spring force of the actuator spring to abut the rear of the cavity with the latch released, displacing the push rod from the rear of the cavity to a position releasing the pawl.

9. A device as in claim 8 wherein the latch is elongated, parallel to the axes of the plungers, has a front and rear end and fits within the cavity the latch front end affixed to the inner plunger, the latch rear end biased to splay from the inner plunger into a chamber in the outer plunger aligned with the latch.

10. A device as in claim 9 wherein the trigger is held in an orifice in the body and has a part extending into the chamber proximate to the rear end of the latch, and the outer plunger has a longitudinal slot aligned with and wider than the part of the trigger extending into the chamber, the slot in communication with the chamber and narrower than the latch.

11. A device as in claim 10 further comprising a means for providing spring force to the main spring including a lever having two ends, one lever end being pivotally attached to the body, and a shaft which is pivotally attached to the lever between the lever ends, the shaft having a hook distal to the lever, the hook disposed to catch on a collar on the outer plunger.

12. A telescoping cue stick for providing an adjustable impact to an object comprising:

an elongated body having front and rear ends and containing an axial bore open at the front end, a main spring mounted in said bore, inner and outer plungers having parallel axes, the outer plunger slidably encased within the bore and connected by the main spring to the body, the inner plunger slidably encased within a cavity axially defined in the outer plunger, the main spring generally coaxial with the outer plunger, cocking means for temporarily engaging the outer plunger in a selected, continuously variable position compressing the main spring, the inner plunger attached to the outer plunger by an actuator spring which is biased toward forcing the inner plunger to disengage the outer plunger, a two position latch mounted on the inner plunger holding, in one position, the inner plunger away from disengaging the outer plunger, and a trigger means urging the two position latch into a second position contacting the inner plunger and allowing the actuator spring to pull the inner plunger rearward a set distance, disengaging the outer plunger and releasing the main spring, driving the outer plunger forward at least the same distance as said set distance, the outer plunger carrying the inner plunger for impact with an object.

13. A device as in claim 12 wherein the cocking means comprises a pawl and ratchet, the ratchet having an associated means for signalling the amount of compression of the main spring thereby yielding a known amount of force transmitted by the device.

14. A device as in claim 13 further comprising a push rod slidably disposed between the inner plunger and the pawl, wherein the inner plunger is biased by the actuator spring to displace the push rod, the push rod urging the pawl to a released position relative to the ratchet.

15. A device as in claim 14 wherein the latch has a front end and a rear end and fits within the cavity, the latch front end attached to the inner plunger, the latch rear end biased to bend outward into a chamber in the outer plunger that is aligned with the latch near a front end of the cavity, the trigger means having a push button and extending through an orifice in the body and into the chamber and contacting the latch.

16. A device as in claim 15 wherein the outer plunger has a slot parallel to its axis, the slot adjoining the chamber and aligned with the push button, the slot being wider than the push button and narrower than both the chamber and the rear end of the latch, so that the rear end of the latch catches on the outer plunger where the chamber adjoins the slot.

17. A device as in claim 16 wherein the outer plunger, the inner plunger, the bore and the cavity are generally cylindrical, and the main spring is coiled around the outer plunger in an enlarged section of the bore.

18. A device as in claim 17 wherein the orifice contains a trigger spring holding the trigger means away from the latch.

19. A device as in claim 18 wherein the rear portion of the latch is notched at a corner distal to the inner plunger, the notch defining a head and a shoulder, the head held within the cavity and the shoulder caught on the outer plunger where the chamber adjoins the slot.

20. A device as in claim 19 wherein the inner plunger and outer plunger are coaxial, and the inner plunger protrudes from the front of the cavity.

21. A device as in claim 20 wherein the ratchet has a front end closer to the front end of said body and a rear end closer to the rear end of said body and teeth which are more closely spaced near the front end of the ratchet than near the rear end of the ratchet.

22. A device as in claim 21 further comprising:

a lever having a base which is pivotally attached to the body near the rear end of the body, a rod having a first and second end, the rod first end pivotally attached to the lever near the base of the lever, the rod second end shaped as a hook and in a position to hold a collar on the outer plunger, the rod aligned with a longitudinal slot in the body.

23. A device as in claim 22 wherein a key having front and rear portions is disposed within a channel in the body that is located at a different radial angle than both the hook and the trigger, the key attached at its front portion to the body, the key having an inner surface at the key rear portion arching inwardly and terminating in a lip protruding through the chamber and into a recess in the inner plunger, whereby the inner plunger is held stationary relative to the body until the outer plunger has moved back relative to the inner plunger a set amount.

* * * * *